United States Patent [19]

Hanfling et al.

[11] 4,007,460

[45] Feb. 8, 1977

[54] PHASED ARRAY ELEMENT RETENTION

[75] Inventors: Jerome D. Hanfling, Framingham; Karl L. Mengoli, Weston, both of Mass.

[73] Assignee: The United States of America as represented by the Secretary of the Army, Washington, D.C.

[22] Filed: Nov. 28, 1975

[21] Appl. No.: 636,002

[52] U.S. Cl. ..... 343/776; 343/879

[51] Int. Cl.[2] ..... H01Q 13/02

[58] Field of Search ..... 343/777, 778, 854, 776, 343/879

*Primary Examiner*—Eli Lieberman

*Attorney, Agent, or Firm*—Nathan Edelberg; Robert P. Gibson; Charles R. Carter

[57] ABSTRACT

A means for retaining radar elements in a structural configuration for a phased array. The elements are inserted in connectors and are held between two cap plates. The array face and retention configuration is to satisfy electrical and mechanical requirements in order to minimize surface-wave propagation and to predict scanning performance.

2 Claims, 4 Drawing Figures

PHASED ARRAY ELEMENT RETENTION

SUMMARY OF THE INVENTION

In a phased array antenna it is desirable to design the array face so that it is flush and has no protrusions or no breaks between apertures. This is necessary to minimize surface-wave propagation. The apertures should be circular and as large as possible for the wide-band and wide-angle impedence matching. Since breaks occur between apertures in order to install and remove elements, these breaks must be made to appear like a short circuit at RF. This has to be done to minimize surface-wave effects. Although the breaks are undesirable from an RF view point, they help to prevent a sheet of water from forming on the array face. For substantial rain rates, a ditch below the element face is required to carry off the water. The present invention has provided a perforated ground plane permitting water to be collected and drained off while not affecting RF performance.

This invention may be better understood from the following detailed description taken in conjunction with the accompanying drawing.

DESCRIPTION OF THE PREFERRED EMBODIMENT

Figure 1:
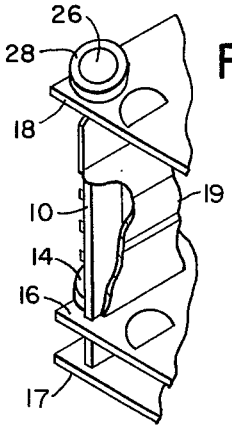
FIG. 1 is partial section view showing radar elements retained in an array structure.

As seen in FIG. 1, an electrical radar element 10 is inserted through a retention cup 12 into a connector 14 and held between a lower cap plate 16 and an upper cap plate 18.

Figure 3:
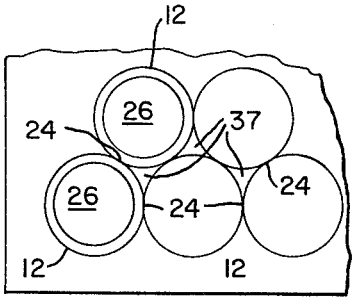
FIG. 3 is a partial top view of FIG. 1 showing a plurality of cup retainers and radar elements.
Figure 4:
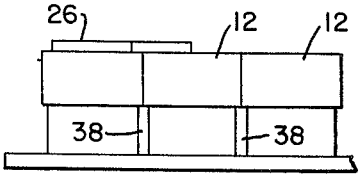
FIG. 4 is a partial side view of FIG. 3 showing tangency points of contact of the retention cups and the rain ditch.
Figure 2:
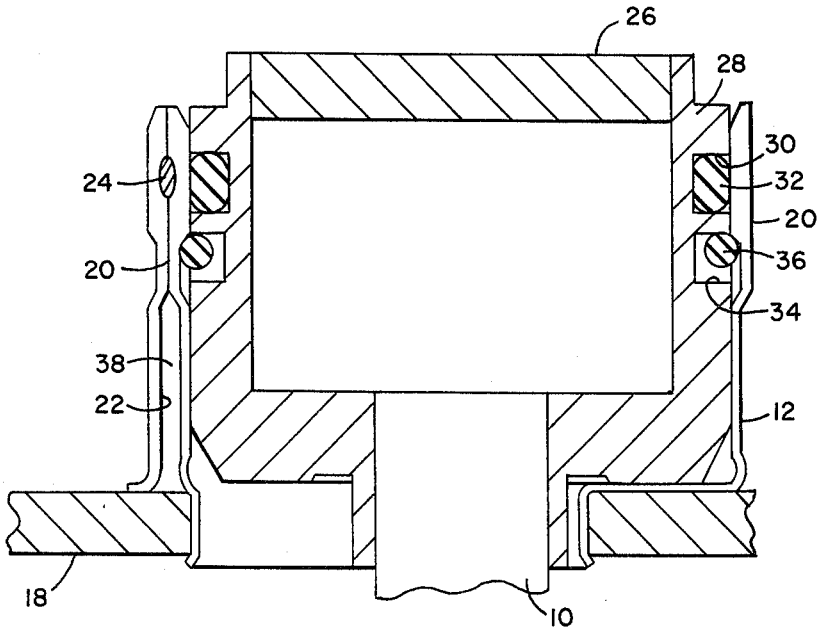
FIG. 2 is sectional view showing the element retention means.

In FIG. 2, one retention cup is shown attached to upper cap plate 18. Each cup 12 includes an annular land 20 and an annular groove 22 formed on the outer surface thereof. The diameter of the annular land is larger than the diameter of the annular groove. As shown in FIGS. 2 and 3, each adjoining cup is spot welded at 24, at cup tangency points to form an electrical ground plane slightly below the radar array radiating surface 26. Plate 17 is provided as a support plate while 19 is supporting structure.

As more clearly seen in FIG. 2 element 10 has a cup engaging end 28 that has its outer periphery provided with an annular recess 30 for housing a radial compressive O-ring seal 32. This seal is carried by the end 28 and is compressed radially between the end and the retention cup 12 when the element is inserted into the cup. The cup engaging end 28 is provided with a second annular recess 34 for housing a snap ring 36 which locks the end 28 and hence the elements 10 in the retention cup whenever the element is inserted into the cup as shown in FIG. 2. Rain drainage channels 37 are formed between the welded external tangency points of the cups and connect to a rain ditch 38, formed between annular grooves 22 of adjoining cups, at the base of the cups. This ditch provides a means for carrying off excessive rain water while not affecting RF performance radiating from surface 26.

We claim:

1. In a phased array structure having a plurality of radar elements disposed in parallel retained relation; each of said elements having an outer connecting end including a radiating face at its outer extremity and provided with an upper annular recess and a lower annular recess, a radial conductive O-ring seal disposed in said upper recess and a snap ring disposed in said lower recess; a retention cup carried by said structure and disposed around the element connecting end, said retention cup being provided with an annular land for sealing cooperation with said O-ring and being provided with an annular groove wherein said snap ring expands when said element is placed for retention in said cup to lock the element to the cup.

2. A phased array structure as set forth in claim 1 wherein the external tangency points of the retention cup annular lands are spot welded and wherein said annular groove provides a drainage ditch.

* * * * *